US012623872B2

(12) United States Patent
Tanaka et al.

(10) Patent No.: US 12,623,872 B2
(45) Date of Patent: May 12, 2026

(54) FEEDING DEVICE, TRANSPORTING DEVICE, AND PROCESSING SYSTEM

(71) Applicant: FUJIFILM Business Innovation Corp., Tokyo (JP)

(72) Inventors: Katsumi Tanaka, Kanagawa (JP); Raita Doi, Kanagawa (JP); Teisuke Yanagawa, Kanagawa (JP); Tomokazu Kurita, Kanagawa (JP)

(73) Assignee: FUJIFILM Business Innovation COrp., Tokyo (JP)

( * ) Notice: Subject to any disclaimer, the term of this patent is extended or adjusted under 35 U.S.C. 154(b) by 347 days.

(21) Appl. No.: 18/188,467

(22) Filed: Mar. 23, 2023

(65) Prior Publication Data

US 2024/0092601 A1 Mar. 21, 2024

(30) Foreign Application Priority Data

Sep. 21, 2022 (JP) ..... 2022-150570

(51) Int. Cl.

| | |
|---|---|
| ***B65H 3/12*** | (2006.01) |
| ***B65H 1/02*** | (2006.01) |
| ***B65H 29/12*** | (2006.01) |
| ***B65H 29/24*** | (2006.01) |
| ***B65H 31/02*** | (2006.01) |

(Continued)

(52) U.S. Cl.

CPC ..... *B65H 3/124* (2013.01); *B65H 1/02* (2013.01); *B65H 3/126* (2013.01); *B65H 29/12* (2013.01); *B65H 29/242* (2013.01); *B65H 31/02* (2013.01); *B65H 31/36* (2013.01); *B65H 83/02* (2013.01); *B65H 2301/321* (2013.01); *B65H 2301/324* (2013.01); *B65H 2301/4213* (2013.01); *B65H 2301/4214* (2013.01); *B65H 2301/42372* (2013.01); *B65H 2301/44735* (2013.01); *B65H 2404/2691* (2013.01); *B65H 2511/11* (2013.01)

(58) Field of Classification Search

CPC ..... B65H 1/02; B65H 3/124; B65H 3/126; B65H 29/12; B65H 29/242; B65H 31/02; B65H 31/34; B65H 31/36; B65H 83/02; B65H 2301/4213; B65H 2301/4214; B65H 2301/42322; B65H 2301/42372; B65H 2301/44735; B65H 2404/2691; B65H 31/20; B65H 2301/321; B65H 2301/324; B65H 2511/11

See application file for complete search history.

(56) References Cited

U.S. PATENT DOCUMENTS 3,947,018 A * 3/1976 Stange ..... B65H 3/126 271/211
5,836,582 A * 11/1998 Ogawa ..... B65H 3/126 271/99

(Continued)

FOREIGN PATENT DOCUMENTS

JP 2015082001 4/2015

*Primary Examiner* — Prasad V Gokhale
(74) *Attorney, Agent, or Firm* — JCIPRNET

(57) ABSTRACT

A feeding device includes: a loading portion that is disposed on a downstream side of a transporting path in a transporting direction and that loads a transporting target, which is transported through the transporting path, on a loading surface inclined with respect to a horizontal direction; and a feeding unit that feeds the transporting target, which is in contact with the loading surface, obliquely upward along the loading surface.

13 Claims, 14 Drawing Sheets

(51) Int. Cl.
*B65H 31/36* (2006.01)
*B65H 83/02* (2006.01)

(56) References Cited

U.S. PATENT DOCUMENTS

| | | | | | |
|---|---|---|---|---|---|
| 5,967,507 | A * | 10/1999 | Moore | B65H 29/70 | 271/99 |
| 2008/0237964 | A1* | 10/2008 | Kiriyama | B65H 29/60 | 270/58.27 |
| 2022/0317623 | A1* | 10/2022 | Nagasaki | B65H 29/242 | |

* cited by examiner

FEEDING DEVICE, TRANSPORTING DEVICE, AND PROCESSING SYSTEM

CROSS-REFERENCE TO RELATED APPLICATIONS

This application is based on and claims priority under 35 USC 119 from Japanese Patent Application No. 2022-150570 filed Sep. 21, 2022.

BACKGROUND

(i) Technical Field

The present invention relates to a feeding device, a transporting device, and a processing system.

(ii) Related Art

JP-2015-82001A discloses a post-processing apparatus including: a transporting path that transports paper on which an image is formed by an image forming apparatus; a retraction unit that is provided at a position branched from the transporting path via a branch point and that retracts the paper on the transporting path; a transporting unit that transports paper positioned on an upstream side of the branch point to the retraction unit in a case where a transporting abnormality of the paper occurs on a downstream side of the branch point in the transporting path; a display unit that performs a display for a user to perform an operation to remove stationary paper that stops on the downstream side of the branch point in the transporting path after the transporting abnormality has occurred; a control unit that controls the image forming apparatus to form an image, which is formed on the stationary paper, on new paper; and a supply unit that supplies the paper retracted to the retraction unit to the transporting path after the newly formed paper has transported through the transporting path and has passed through the branch point.

SUMMARY

As a feeding device, a feeding device including: a loading portion that is disposed on a downstream side of a transporting path in a transporting direction and that loads a transporting target, which is transported through the transporting path, on a loading surface disposed along a horizontal direction; and a feeding unit that feeds the transporting target, which is in contact with the loading surface, along the horizontal direction, is conceivable.

In the feeding device, since the weight of the transporting target, which is loaded on the loading portion, acts in a load direction, in a case where the feeding unit feeds the transporting target, double feeding of the transporting target (a plurality of transporting targets are overlapped and fed) may occur.

Aspects of non-limiting embodiments of the present disclosure relate to a feeding device, a transporting device, and a processing system in which double feeding of the transporting target is suppressed as compared with a case where a transporting target, which is loaded on a loading surface disposed along the horizontal direction, is fed along the horizontal direction.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a feeding device including: a loading portion that is disposed on a downstream side of a transporting path in a transporting direction and that loads a transporting target, which is transported through the transporting path, on a loading surface inclined with respect to a horizontal direction; and a feeding unit that feeds the transporting target, which is in contact with the loading surface, obliquely upward along the loading surface.

BRIEF DESCRIPTION OF THE DRAWINGS

Exemplary embodiment(s) of the present invention will be described in detail based on the following figures, wherein.

DETAILED DESCRIPTION

An example of an exemplary embodiment of the present invention will be described below with reference to the drawings.

Processing System 100

Figure 1:
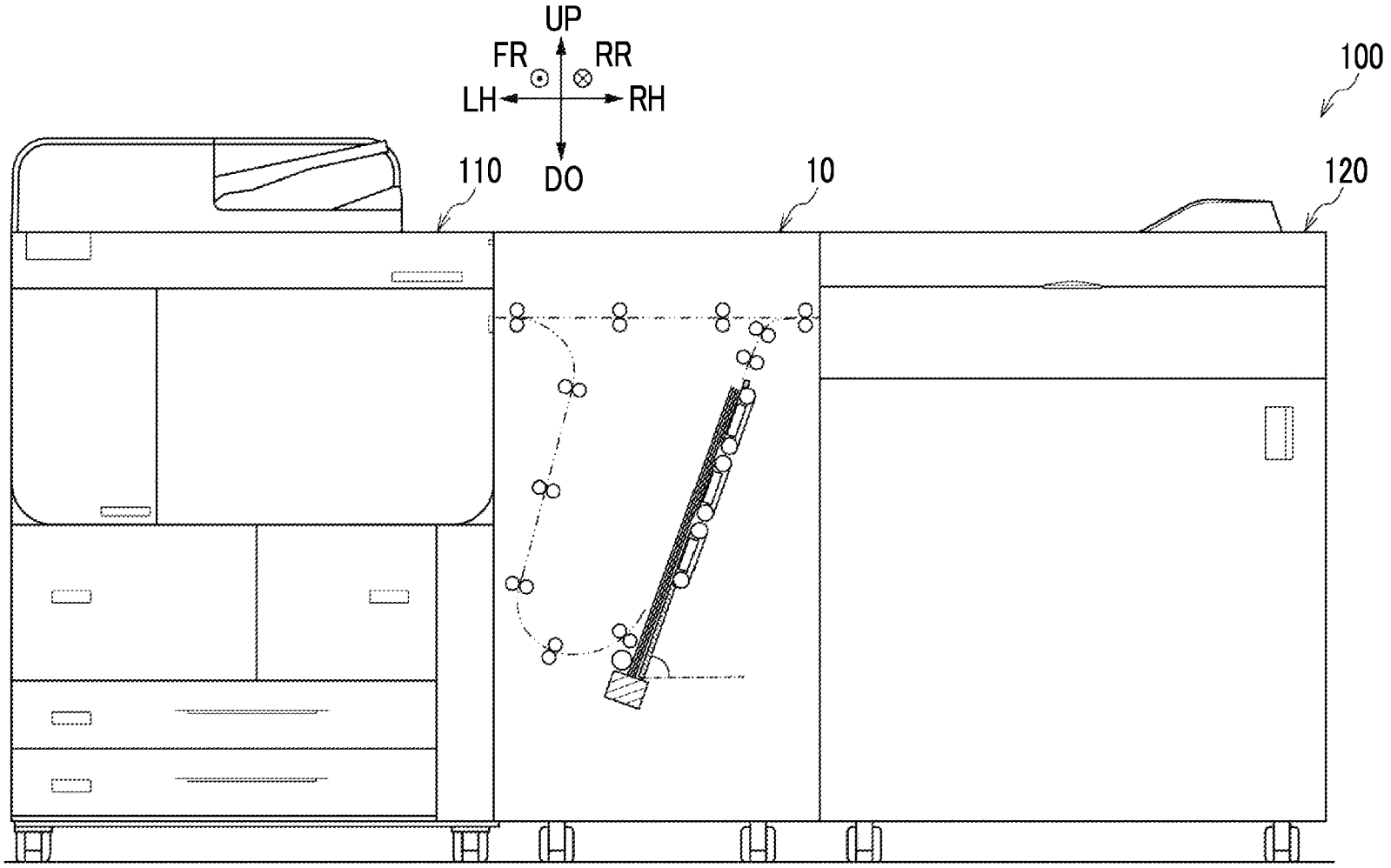
FIG. 1 is a schematic view illustrating a processing system according to the present exemplary embodiment.

First, a processing system 100 according to the present exemplary embodiment will be described. FIG. 1 is a schematic view illustrating the processing system 100 according to the present exemplary embodiment.

An arrow UP illustrated in the figure indicates an up side of an apparatus, and an arrow DO indicates a down side of the apparatus. Further, an arrow LH illustrated in the figure indicates a left side of the apparatus, and an arrow RH indicates a right side of the apparatus. Further, an arrow FR illustrated in the figure indicates a front side of the apparatus, and an arrow RR indicates a rear side of the apparatus. Since these directions are directions determined for convenience of description, a configuration of the apparatus is not limited to these directions. The term "apparatus" may be omitted in each direction of the apparatus. That is, for example, the "up side of the apparatus" may be simply referred to as the "up side".

The up-down direction, the right-left direction, and the front-rear direction are directions intersecting each other (specifically, directions orthogonal to each other). The "right-left direction" can also be said to be a side, a lateral direction, and a horizontal direction. The term "front-rear direction" may be used to describe "both the front side and the rear side" or "either one of the front side or the rear side". The "front-rear direction" can also be said to be a side, a lateral direction, and a horizontal direction.

Further, a symbol in which "x" is described in "o" in the figure describes an arrow from the front to the back of the paper. Further, a symbol in which " " is described in "o" in the figure describes an arrow from the back to the front of the paper. Further, a dimensional ratio of each of the parts illustrated in each of the figures in the up-down direction, the right-left direction, and the front-rear direction may differ from the actual dimensional ratio.

The processing system 100 illustrated in FIG. 1 is a system that executes predetermined processing and includes a pre-processing apparatus 110, a post-processing apparatus 120, and a transporting device 10 as illustrated in FIG. 1.

Pre-Processing Apparatus 110

Figure 2:
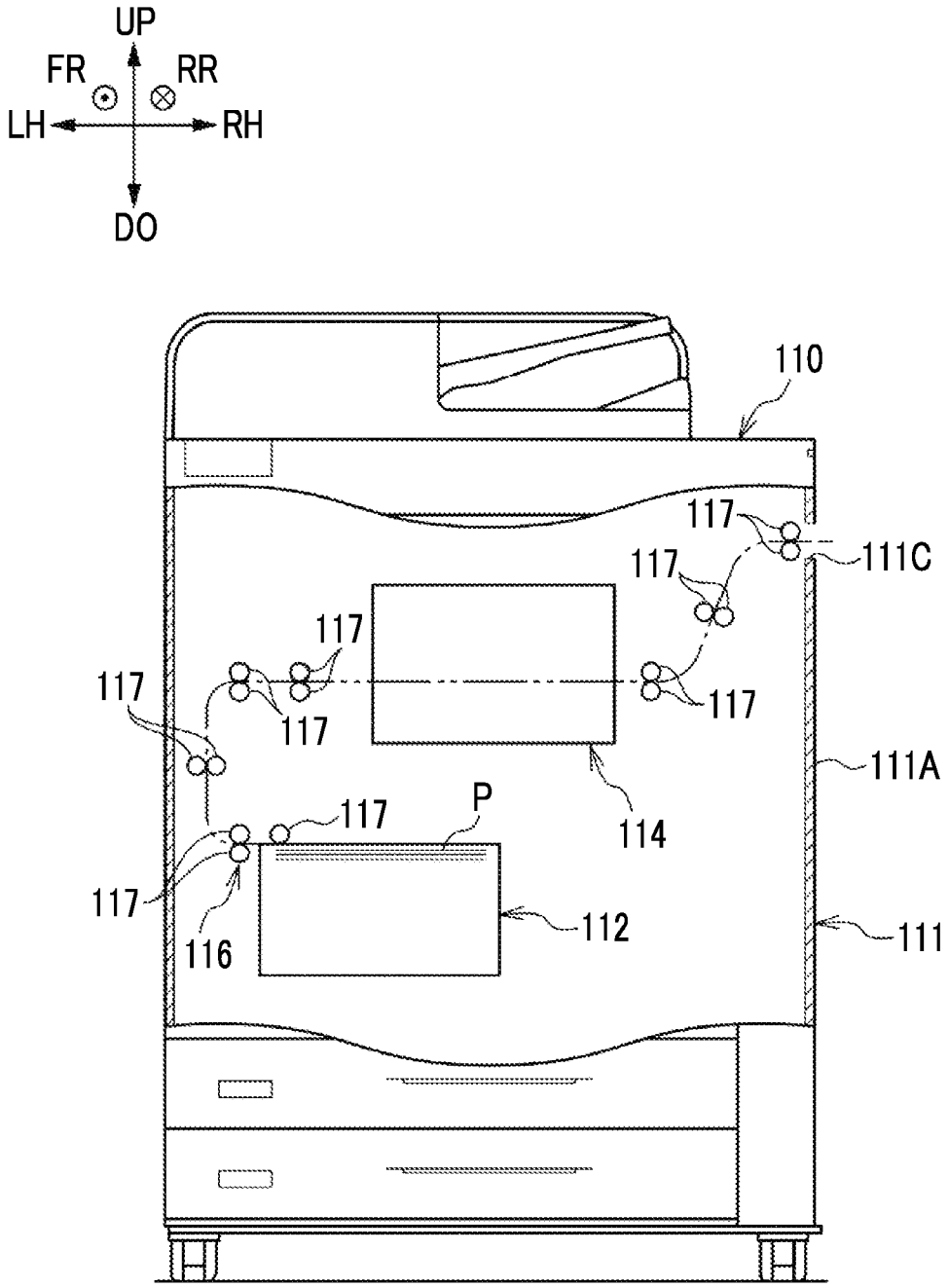
FIG. 2 is a schematic view illustrating a pre-processing apparatus according to the present exemplary embodiment.

FIG. 2 is a schematic view illustrating the pre-processing apparatus 110. The pre-processing apparatus 110 is an apparatus that executes pre-processing. Specifically, the pre-processing apparatus 110 is an image forming apparatus that forms an image on a recording medium P as the pre-processing. The recording medium P is an example of a transporting target.

As illustrated in FIG. 2, the pre-processing apparatus 110 includes an apparatus main body 111, a medium accommodation portion 112, an image forming portion 114 as a pre-processing portion, and a transporting mechanism 116.

Apparatus Main Body 111

The apparatus main body 111 illustrated in FIG. 2 is a part where each configuration portion of the pre-processing apparatus 110 is provided. The apparatus main body 111 includes a box-shaped housing 111A that accommodates each configuration portion of the pre-processing apparatus 110. In the present exemplary embodiment, as illustrated in FIG. 2, for example, the medium accommodation portion 112, the image forming portion 114, and the transporting mechanism 116 are provided inside the apparatus main body 111.

Medium Accommodation Portion 112

As illustrated in FIG. 2, the medium accommodation portion 112 is a part where the recording medium P is accommodated in the pre-processing apparatus 110. The recording medium P, which is accommodated in the medium accommodation portion 112, is supplied to the image forming portion 114. As the recording medium P, for example, paper is used.

Image Forming Portion 114

The image forming portion 114 illustrated in FIG. 2 is a configuration portion that forms an image on the recording medium P, which is fed from the medium accommodation portion 112, as pre-processing. As the image forming portion 114, for example, an electrophotographic type image forming portion, which forms an image on the recording medium P by using toner, is used.

In the electrophotographic type image forming portion, for example, each process of charging, exposure, development, transfer, and fixing is performed to form an image on the recording medium P. As the electrophotographic type image forming portion, each process of charging, exposure, development, and transfer may be performed to form an image on a transfer body, and an image may be formed on the recording medium P by transferring the image from the transfer body to the recording medium P and then fixing the image on the recording medium P.

The example of the image forming portion is not limited to the electrophotographic type image forming portion described above, and may be, for example, an ink jet type image forming portion, and various image forming portions can be used. In the ink jet type image forming portion, for example, ink droplets are ejected from an ejection portion to the recording medium P to form an image on the recording medium P.

Here, the pre-processing is processing executed on the transporting target before the transporting target is transported by the transporting device 10. In the pre-processing apparatus 110, the image forming portion 114 as the pre-processing portion executes image forming, but the present exemplary embodiment is not limited thereto. The pre-processing may be, for example, image reading processing of reading an image of the transporting target, feeding processing of feeding the transporting target, transporting processing of transporting the transporting target, or the like, and may be processing that is executed before the transporting target is transported by the transporting device 10.

Transporting Mechanism 116

The transporting mechanism 116 illustrated in FIG. 2 is a mechanism that transports the recording medium P. As an example, the transporting mechanism 116 transports the recording medium P by using a transporting member 117 such as a transporting roll. The transporting member 117 may be a transporting belt or the like and may be any member as long as the transporting member can transport the recording medium P by applying a transporting force to the recording medium P.

The transporting mechanism 116 transports the recording medium P from the medium accommodation portion 112 to the image forming portion 114. Further, the transporting mechanism 116 transports the recording medium P to a discharging port 111C provided in the apparatus main body 111.

Post-Processing Apparatus 120

Figure 3:
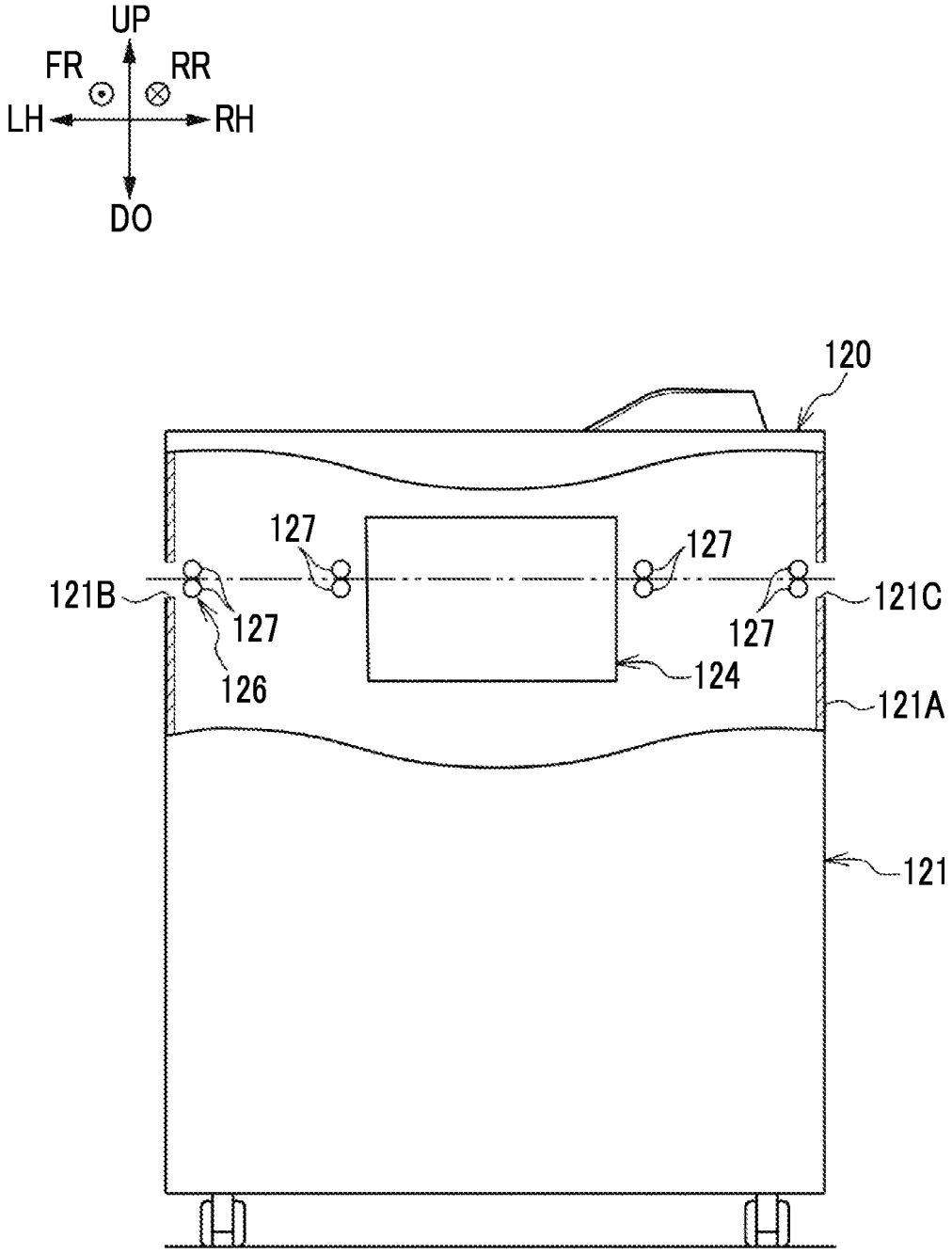
FIG. 3 is a schematic view illustrating a post-processing apparatus according to the present exemplary embodiment.

FIG. 3 is a schematic view illustrating the post-processing apparatus 120. The post-processing apparatus 120 is an apparatus that executes post-processing. Specifically, as illustrated in FIG. 3, the post-processing apparatus 120 includes an apparatus main body 121, a post-processing portion 124, and a transporting mechanism 126.

Apparatus Main Body 121

The apparatus main body 121 illustrated in FIG. 3 is a part where each configuration portion of the post-processing apparatus 120 is provided. The apparatus main body 121 includes a box-shaped housing 121A that accommodates each configuration portion of the post-processing apparatus 120. In the present exemplary embodiment, as illustrated in FIG. 3, for example, the post-processing portion 124 and the transporting mechanism 126 are provided inside the apparatus main body 121.

Post-Processing Portion 124

The post-processing portion 124 illustrated in FIG. 3 is a configuration portion that executes predetermined post-processing on the recording medium P transported from the transporting device 10. Specifically, as the post-processing, the post-processing portion 124 executes, for example, binding processing of binding a plurality of recording media P.

Here, the post-processing is processing executed on the transporting target after the transporting target is transported by the transporting device 10. In the post-processing apparatus 120, the post-processing portion 124 executes the binding processing, but the present exemplary embodiment is not limited thereto. The post-processing may be, for example, folding processing of folding the transporting target, cutting processing of cutting the transporting target, hole punching processing of punching a hole in the transporting target, book-binding processing of book-binding a plurality of the transporting targets, or the like, and may be processing that is executed after the transporting target is transported by the transporting device 10. Further, in a case where the feeding processing of feeding the transporting target is executed as the pre-processing, the image forming processing of forming an image may be executed as the post-processing.

Transporting Mechanism 126

The transporting mechanism 126 illustrated in FIG. 3 is a mechanism that transports the recording medium P. As an example, the transporting mechanism 126 transports the recording medium P by using a transporting member 127 such as a transporting roll. The transporting member 127 may be a transporting belt or the like and may be any member as long as the transporting member can transport the recording medium P by applying a transporting force to the recording medium P.

The transporting mechanism 126 transports the recording medium P from an inlet port 121B, which is provided in the apparatus main body 121, to the post-processing portion 124. Further, the transporting mechanism 126 transports the recording medium P from the post-processing portion 124 to a discharging port 121C provided in the apparatus main body 121.

Transporting Device 10

Figure 4:
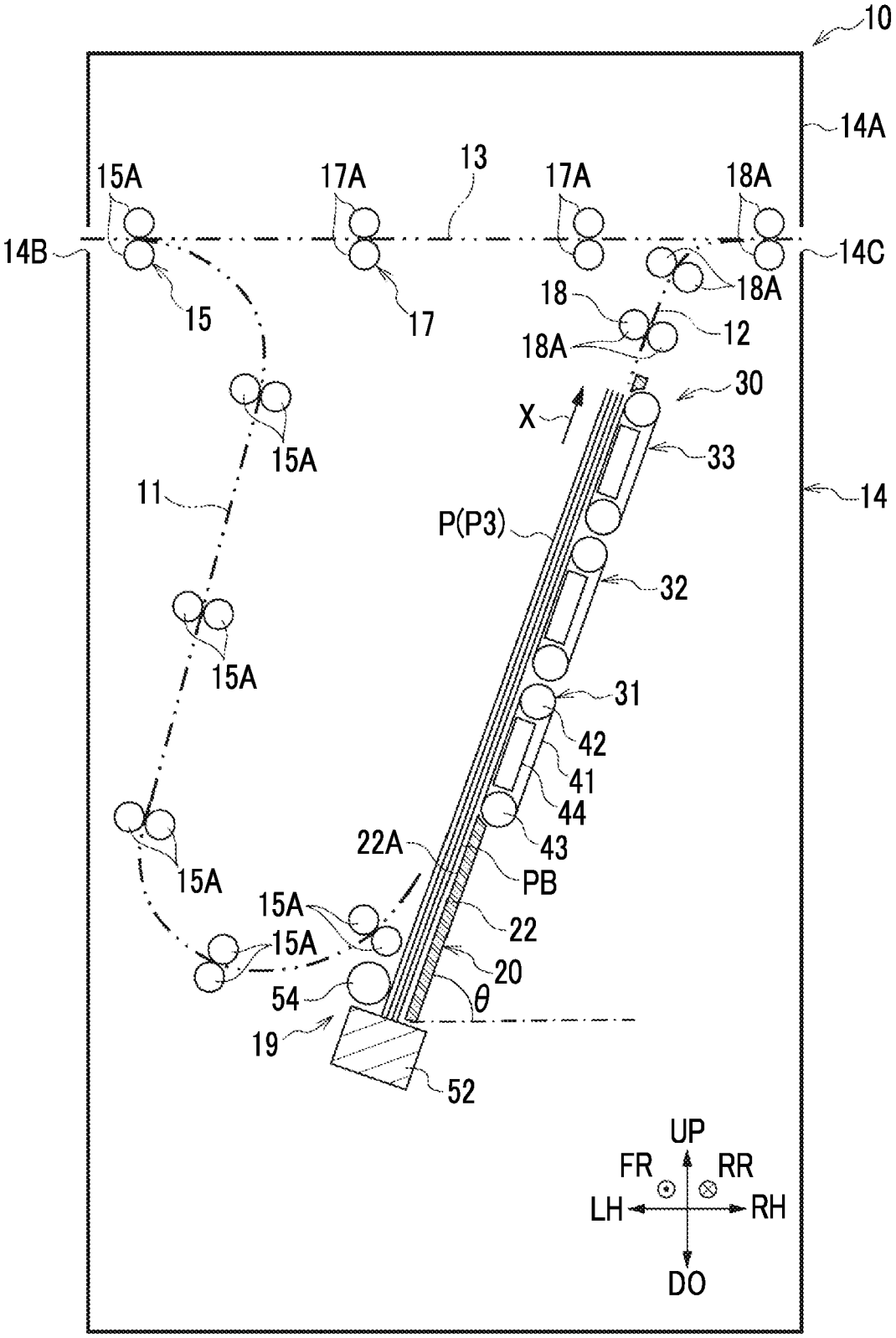
FIG. 4 is a schematic view illustrating a transporting device according to the present exemplary embodiment.

FIG. 4 is a schematic view illustrating the transporting device 10. The transporting device 10 is a device that transports the recording medium P, which is transported from the pre-processing apparatus 110, to the post-processing apparatus 120. Specifically, the transporting device 10 has a function of adjusting the processing timing between the pre-processing and the post-processing by temporarily holding the recording medium P, which is transported from the pre-processing apparatus 110, and then transporting the recording medium P to the post-processing apparatus 120.

In the present exemplary embodiment, the transporting device 10 includes a device main body 14, a first transporting path 11, a first transporting mechanism 15, a second transporting path 12, a second transporting mechanism 18, a bypassing circuit 13, a third transporting mechanism 17, and a feeding device 19.

Device Main Body 14

The device main body 14 illustrated in FIG. 4 is a part where each configuration portion of the transporting device 10 is provided. The device main body 14 includes a box-shaped housing 14A that accommodates each configuration portion of the transporting device 10. In the present exemplary embodiment, as illustrated in FIG. 4, for example, the first transporting path 11, the first transporting mechanism 15, the second transporting path 12, the second transporting mechanism 18, the bypassing circuit 13, the third transporting mechanism 17, and the feeding device 19 are provided inside the device main body 14.

First Transporting Path 11 and First Transporting Mechanism 15

The first transporting path 11 is a transporting path for transporting the recording medium P, which is transported from the pre-processing apparatus 110, from an inlet port 14B provided in the device main body 14 to a loading portion 20 to be described later of the feeding device 19.

The first transporting mechanism 15 is a mechanism that transports the recording medium P in the first transporting path 11. As an example, the first transporting mechanism 15 transports the recording medium P by using a transporting member 15A such as a transporting roll. The transporting member 15A may be a transporting belt or the like and may be any member as long as the transporting member can transport the recording medium P by applying a transporting force to the recording medium P.

Second Transporting Path 12 and Second Transporting Mechanism 18

The second transporting path 12 is a transporting path for transporting the recording medium P, which is fed from the feeding device 19, to the post-processing apparatus 120. Specifically, the second transporting path 12 is a transporting path for transporting the recording medium P, which is fed from the loading portion 20 described later of the feeding device 19, to a discharging port 14C provided in the device main body 14.

The second transporting mechanism 18 is a mechanism that transports the recording medium P in the second transporting path 12. As an example, the second transporting mechanism 18 transports the recording medium P by using a transporting member 18A such as a transporting roll. The transporting member 18A may be a transporting belt or the like and may be any member as long as the transporting member can transport the recording medium P by applying a transporting force to the recording medium P.

Bypassing Circuit 13 and Third Transporting Mechanism 17

The bypassing circuit 13 is a transporting path for transporting the recording medium P, which is transported from the pre-processing apparatus 110, to the second transporting path 12 by bypassing the feeding device 19. Specifically, the bypassing circuit 13 is connected to the first transporting path 11 and the second transporting path 12.

The third transporting mechanism 17 is a mechanism that transports the recording medium P in the bypassing circuit 13. As an example, the third transporting mechanism 17 transports the recording medium P by using a transporting member 17A such as a transporting roll. The transporting member 17A may be a transporting belt or the like and may be any member as long as the transporting member can transport the recording medium P by applying a transporting force to the recording medium P.

Feeding Device 19

The feeding device 19 illustrated in FIG. 4 is a device that feeds the recording medium P. The feeding device 19 includes a loading portion 20, a feeding mechanism 30, a contact portion 52, and an applying roll 54. In each figure, a direction in which the feeding device 19 feeds the recording medium P (hereinafter, the direction may be referred to as a feeding direction) is indicated by an arrow X.

Loading Portion 20

The loading portion 20 includes a loading member 22 having a loading surface 22A inclined with respect to a horizontal direction. The loading member 22 is formed in a plate shape, for example. The loading portion 20 is disposed on a downstream side of the first transporting path 11 in a transporting direction and loads the recording medium P, which is transported through the first transporting path 11, on the loading surface 22A.

Specifically, the downstream side of the first transporting path 11 in the transporting direction is not connected to a downstream side of the loading portion 20 in the feeding direction (specifically, an obliquely upper right side) but is connected to an upstream side of the loading portion 20 in the feeding direction (specifically, an obliquely lower left side). Therefore, the loading portion 20 loads the recording medium P, which is transported through the first transporting path 11, from the upstream side of the loading portion 20 in the feeding direction.

The loading portion 20 can load a first recording medium P1 (see FIGS. 5 to 8), a second recording medium P2 (see FIGS. 8 to 11) having a larger dimension along the feeding direction than a dimension of the first recording medium P1, and a third recording medium P3 (see FIGS. 4, 12, and 13) having a larger dimension along the feeding direction than the dimension of the second recording medium P2, as the recording medium P.

The loading surface 22A is inclined in a range of 45 degrees or more and less than 90 degrees with respect to the horizontal direction (see an angle θ in the figure). Further, the loading surface 22A is, for example, preferably inclined in a range of 60 degrees or more and less than 85 degrees with respect to the horizontal direction. In each figure, the angle of the loading surface 22A with respect to the horizontal direction is indicated by θ.

The loading portion 20 can load, for example, five or more recording media P, preferably 10 or more recording media P, and more preferably 50 or more recording media P. Specifically, the loading portion 20 can load, for example, substantially 100 recording media P.

Feeding Mechanism 30

The feeding mechanism 30 is an example of a feeding unit and is a mechanism that feeds the recording medium P, which is in contact with the loading surface 22A, obliquely upward along the loading surface 22A. In the present exemplary embodiment, the feeding mechanism 30 feeds the recording medium P, which is in contact with the loading surface 22A, obliquely upward along the loading surface 22A while sucking the lower side PB of the recording medium P.

Specifically, the feeding mechanism 30 includes a first transporting portion 31, a second transporting portion 32, and a third transporting portion 33. The first transporting portion 31, the second transporting portion 32, and the third transporting portion 33 are disposed in this order toward the downstream side (specifically, the obliquely upper right side) in the feeding direction. That is, the second transporting portion 32 is disposed on the downstream side of the first transporting portion 31 in the feeding direction. The third transporting portion 33 is disposed on the downstream side of the second transporting portion 32 in the feeding direction.

Each of the first transporting portion 31, the second transporting portion 32, and the third transporting portion 33 includes a transporting belt 41, rolls 42 and 43, and a suction portion 44. The transporting belt 41 is formed in an annular shape (specifically, an endless shape). The transporting belt 41 is formed with a plurality of suction holes (not illustrated) penetrating in a thickness direction.

The rolls 42 and 43 are disposed at intervals in the feeding direction (specifically, an oblique right direction). A transporting belt 41 is wound around the rolls 42 and 43. The suction portion 44 is disposed between the rolls 42 and 43 on an inner periphery of the transporting belt 41. The suction portion 44 sucks the lower side PB of the lowermost recording medium P among the plurality of recording media P loaded on the loading surface 22A, through a suction hole (not illustrated) of the transporting belt 41. As a result, the lowermost recording medium P is attracted to an outer peripheral surface of the transporting belt 41.

Each of the first transporting portion 31, the second transporting portion 32, and the third transporting portion 33 transports the recording medium P, which is attracted to the outer peripheral surface of the transporting belt 41 in the feeding direction (arrow X direction) by rotationally driving at least one of the rolls 42 or 43.

As described above, the first transporting portion 31, the second transporting portion 32, and the third transporting portion 33 suck and transport the lower side PB of the lowermost recording medium P loaded on the loading portion 20. Therefore, in the feeding mechanism 30, the recording media P loaded on the loading portion 20 are fed in the order in which the recording media P are loaded.

Further, the feeding mechanism 30 can feed the recording medium P, which is in contact with the loading surface 22A, obliquely upward along the loading surface 22A while the loading portion 20 further loads the recording medium P in a state in which the loading portion 20 loads the recording medium P.

Since each of the first transporting portion 31, the second transporting portion 32, and the third transporting portion 33 has the same configuration, in FIGS. 4 to 13, the reference numerals of the second transporting portion 32 and the third transporting portion 33 are omitted.

Contact Portion 52

The contact portion 52 illustrated in FIG. 4 is a configuration portion that comes into contact with an upstream end of the recording medium P, which is loaded on the loading portion 20, in the feeding direction to align the upstream end. Specifically, the contact portion 52 is configured with, for example, a wall formed in a block shape or a plate shape.

The contact portion 52 is provided on an upstream side in the feeding direction with respect to the loading portion 20. Further, a position of the contact portion 52 is fixed with respect to the loading portion 20. That is, the contact portion 52 does not move along the feeding direction.

Applying Roll 54

The applying roll 54 illustrated in FIG. 4 is an example of an applying portion and is a configuration portion that applies a movement force to the recording medium P, which is loaded on the uppermost side in the loading portion 20, toward the contact portion 52 side (specifically, the obliquely lower left side) to bring the recording medium P into contact with the contact portion 52.

Specifically, the applying roll 54 applies the movement force to the recording medium P, which is loaded on the uppermost side in the loading portion 20, toward the contact portion 52 side during a feeding operation of the feeding mechanism 30.

Feeding Operation of First Recording Medium P1

Figure 5:
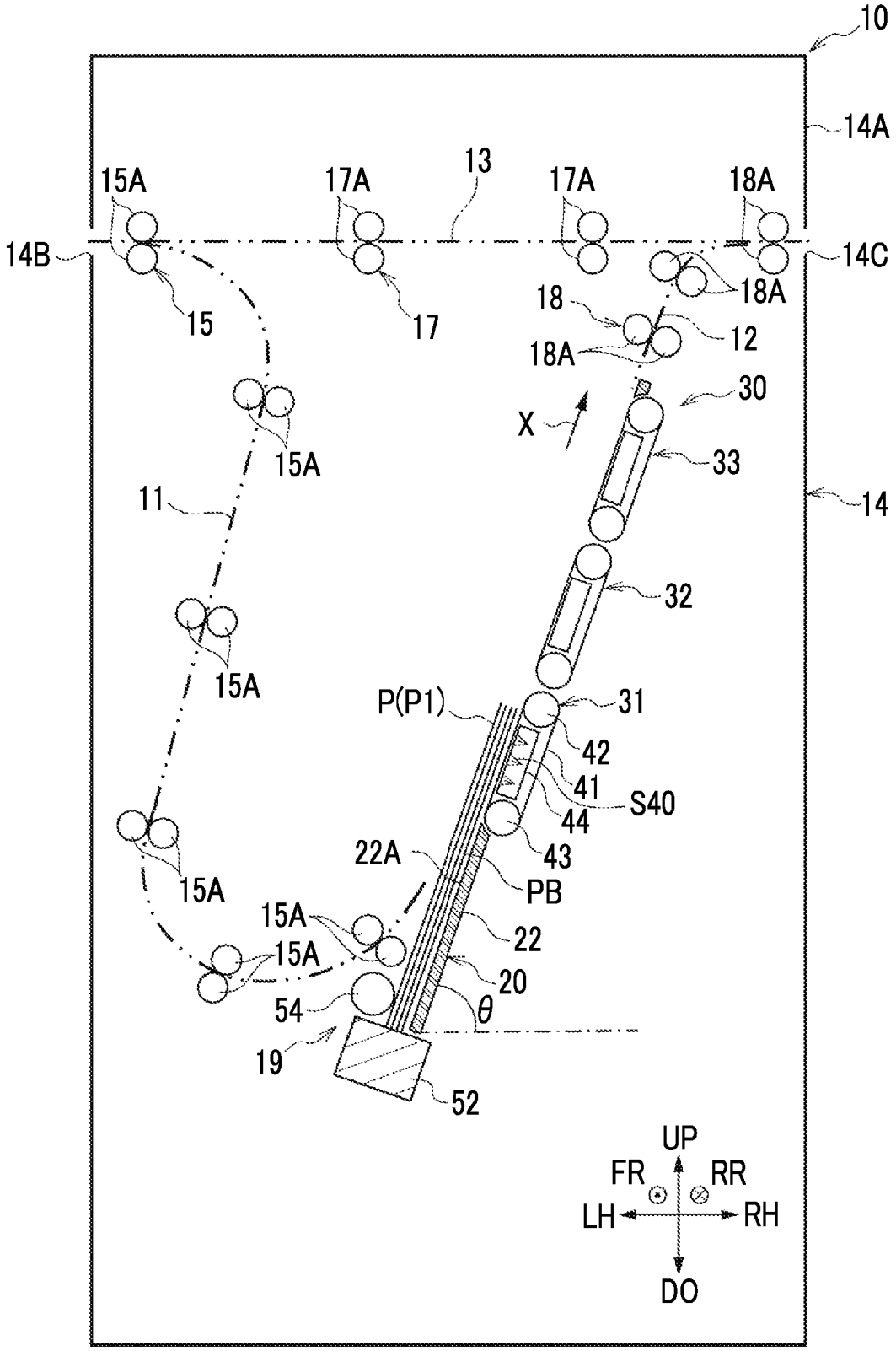
FIG. 5 is an operation view illustrating an operation of feeding a first recording medium in the transporting device according to the present exemplary embodiment.

In the feeding mechanism 30, as illustrated in FIG. 5, the first transporting portion 31 transports the first recording medium P1, which is in contact with the loading surface 22A, obliquely upward along the loading surface 22A while sucking the lower side PB of the first recording medium P1 on a downstream end side in the feeding direction by the suction portion 40. Each figure illustrates that the suction portion 40 to which an arrow S40 is attached is being driven.

Figure 6:
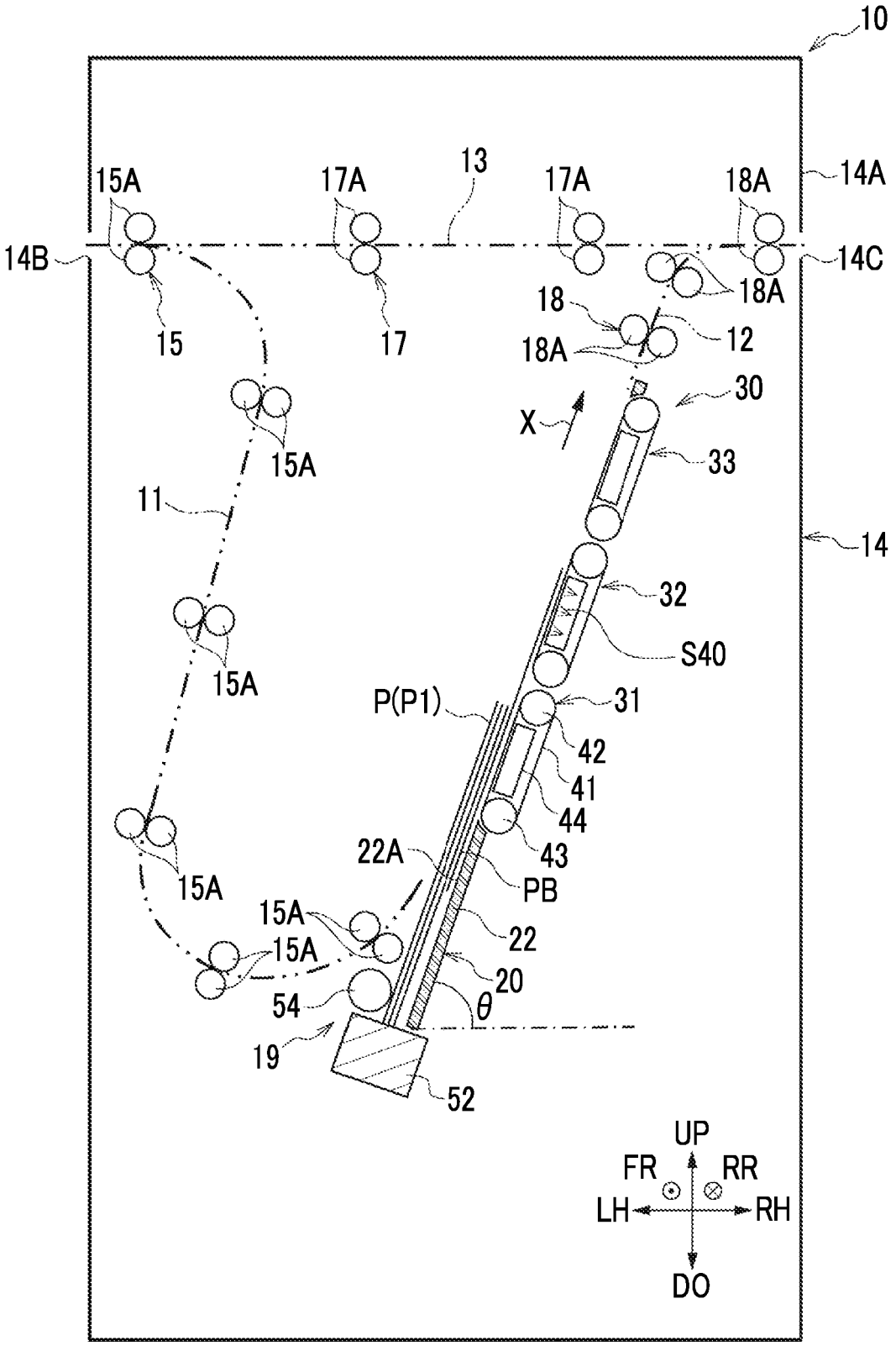
FIG. 6 is an operation view illustrating an operation of feeding the first recording medium in the transporting device according to the present exemplary embodiment.

Further, in the feeding mechanism 30, as illustrated in FIG. 6, the second transporting portion 32 transports the first recording medium P1, which is transported from the first transporting portion 31, while sucking the lower side PB of the first recording medium P1 by the suction portion 40, and the first transporting portion 31 stops the suction in a state in which the second transporting portion 32 transports the first recording medium P1.

Figure 7:
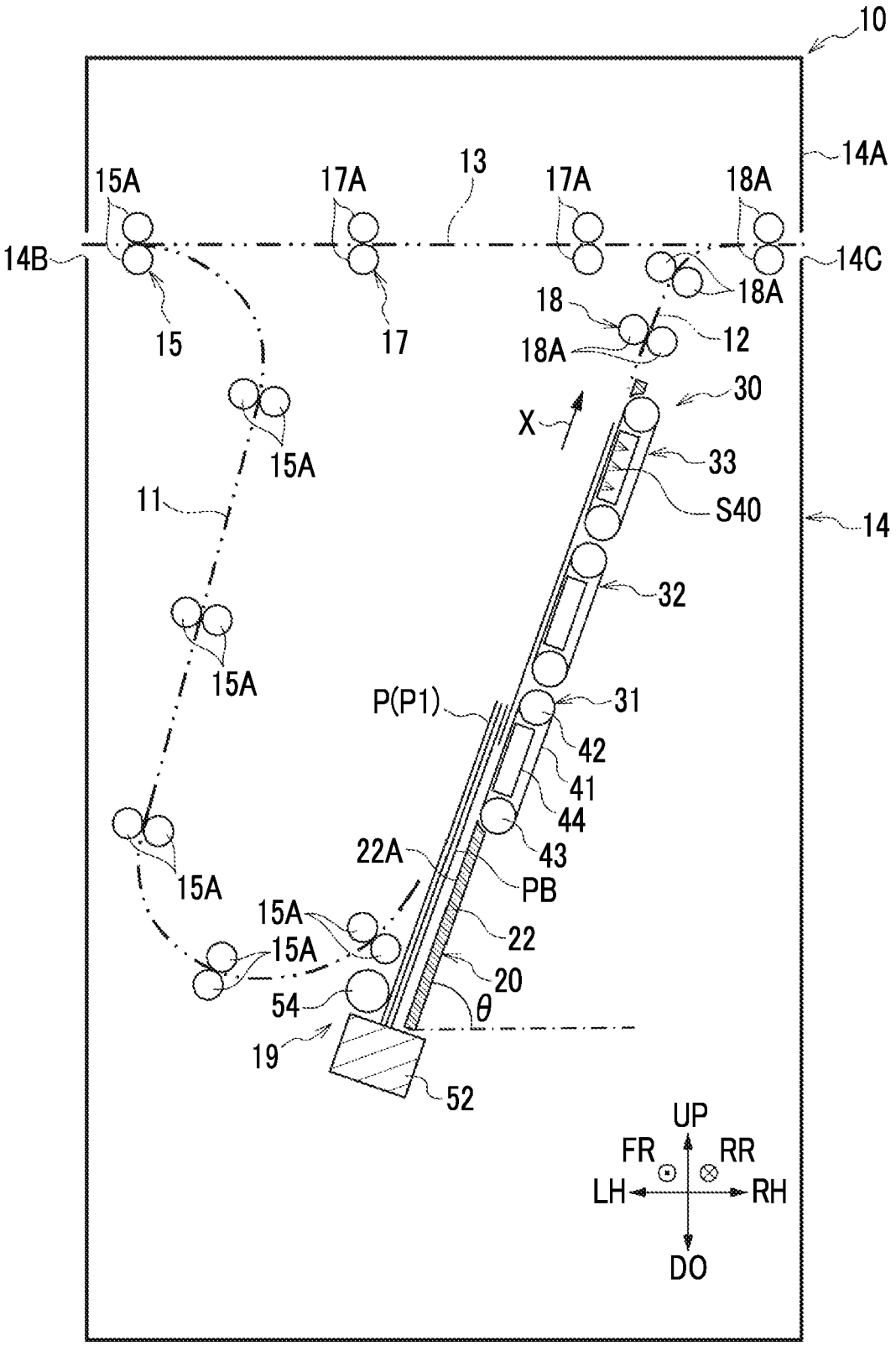
FIG. 7 is an operation view illustrating an operation of feeding the first recording medium in the transporting device according to the present exemplary embodiment.

Further, in the feeding mechanism 30, as illustrated in FIG. 7, the third transporting portion 33 transports the first recording medium P1, which is transported from the second transporting portion 32, while sucking the lower side PB of the first recording medium P1 by the suction portion 40, and the second transporting portion 32 stops the suction in a state in which the third transporting portion 33 transports the first recording medium P1.

Figure 8:
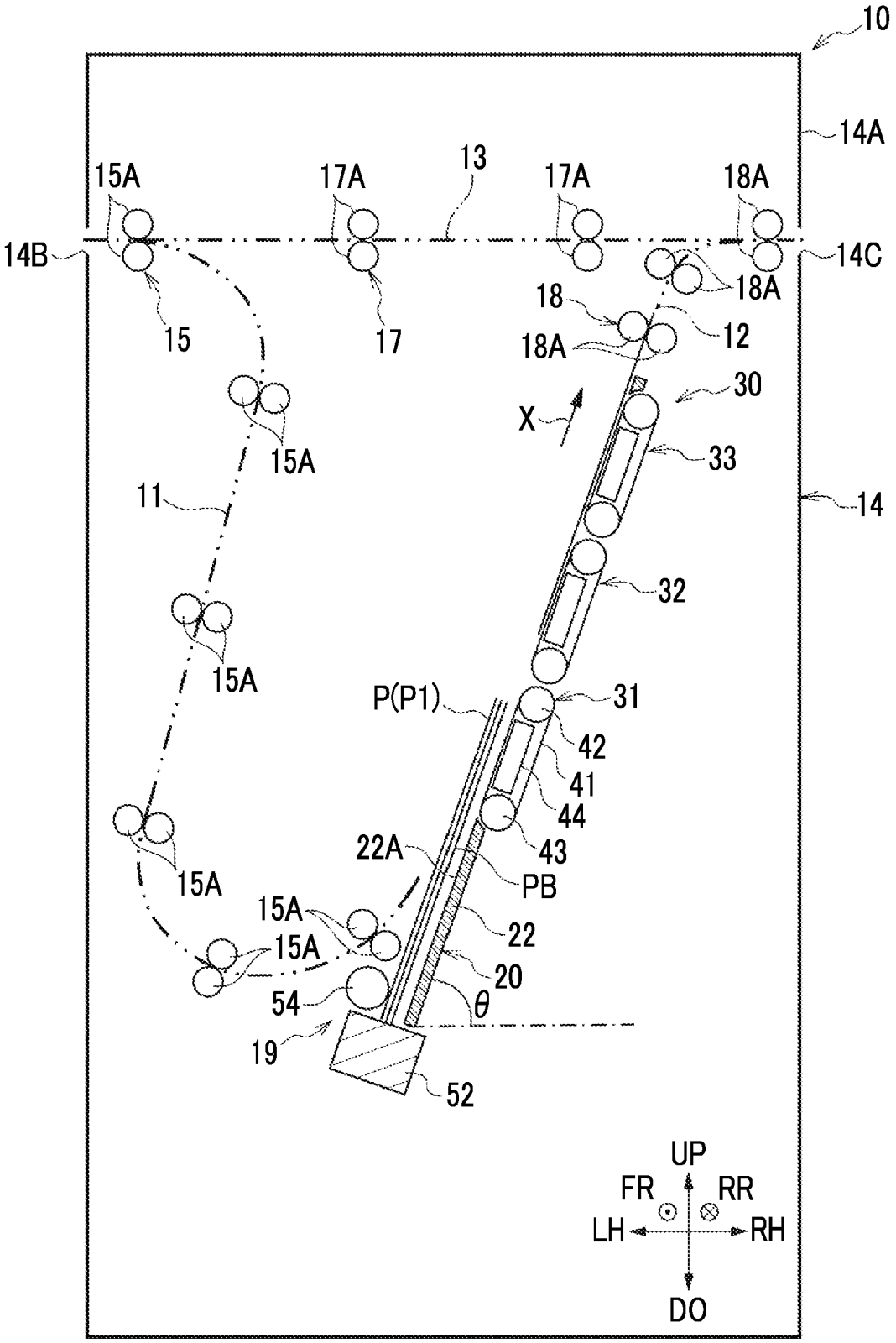
FIG. 8 is an operation view illustrating an operation of feeding the first recording medium in the transporting device according to the present exemplary embodiment.

As illustrated in FIG. 8, in a case where the first recording medium P1, which is transported from the third transporting portion 33, is delivered to the second transporting mechanism 18, the third transporting portion 33 stops the suction. As described above, the first recording medium P1 is fed from the loading portion 20.

Feeding Operation of Second Recording Medium P2

Figure 9:
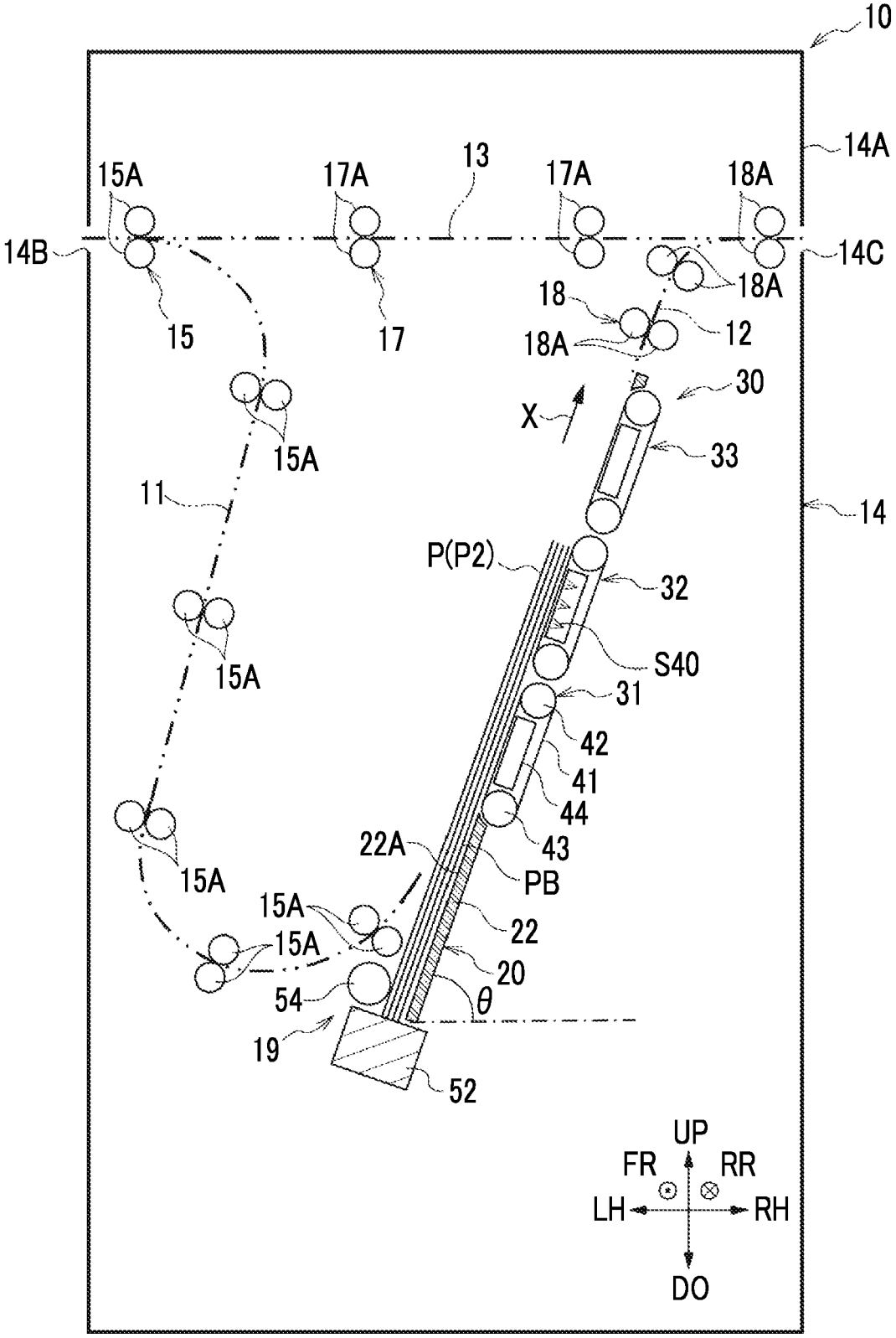
FIG. 9 is an operation view illustrating an operation of feeding a second recording medium in the transporting device according to the present exemplary embodiment.

In the feeding mechanism 30, as illustrated in FIG. 9, the second transporting portion 32 transports the second recording medium P2, which is in contact with the loading surface 22A, obliquely upward along the loading surface 22A while sucking the lower side PB of the second recording medium P2 on a downstream end side in the feeding direction by the suction portion 40.

Figure 10:
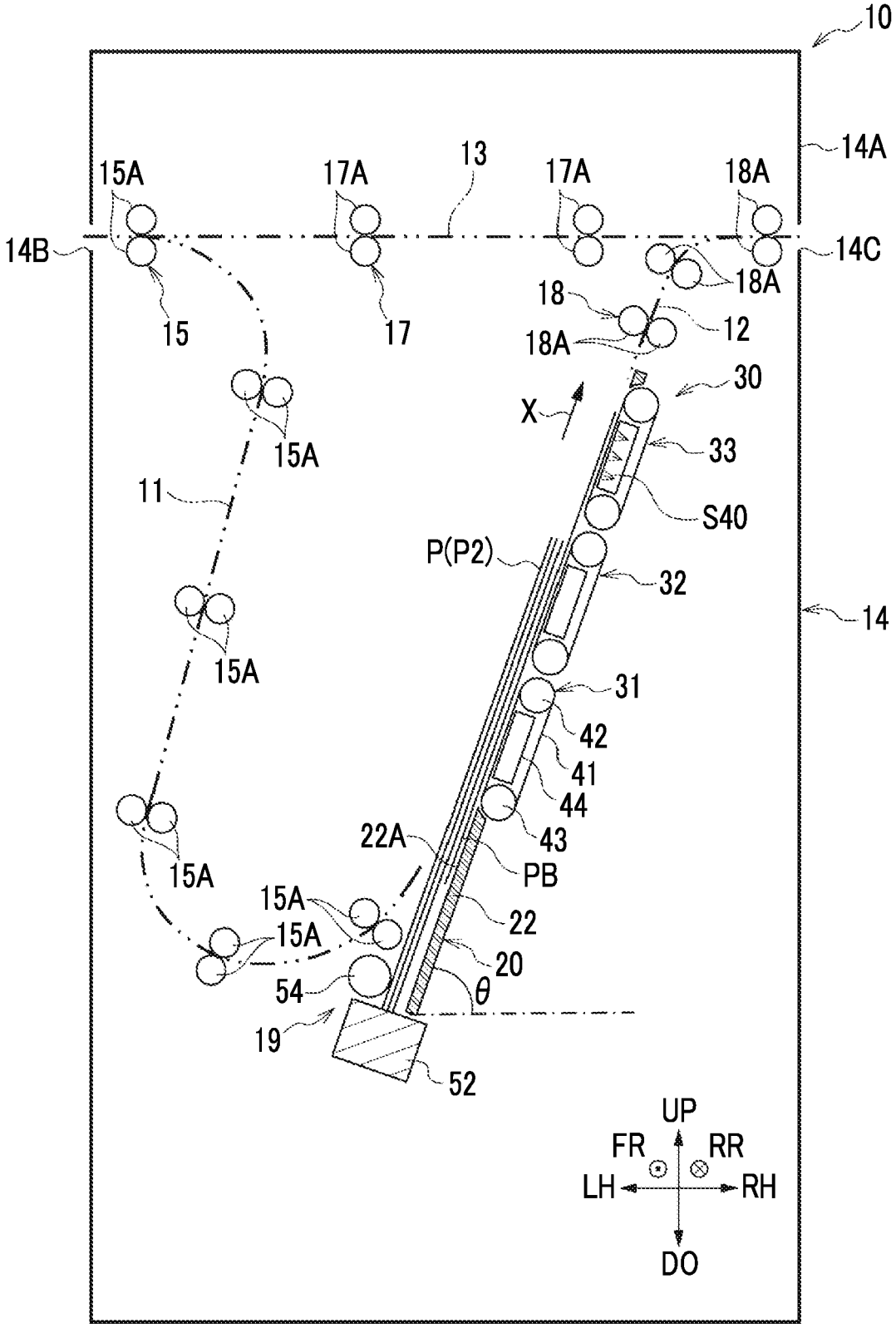
FIG. 10 is an operation view illustrating an operation of feeding the second recording medium in the transporting device according to the present exemplary embodiment.

Further, in the feeding mechanism 30, as illustrated in FIG. 10, the third transporting portion 33 transports the second recording medium P2, which is transported from the second transporting portion 32, while sucking the lower side PB of the second recording medium P2 by the suction portion 40, and the second transporting portion 32 stops the suction in a state in which the third transporting portion 33 transports the second recording medium P2.

Figure 11:
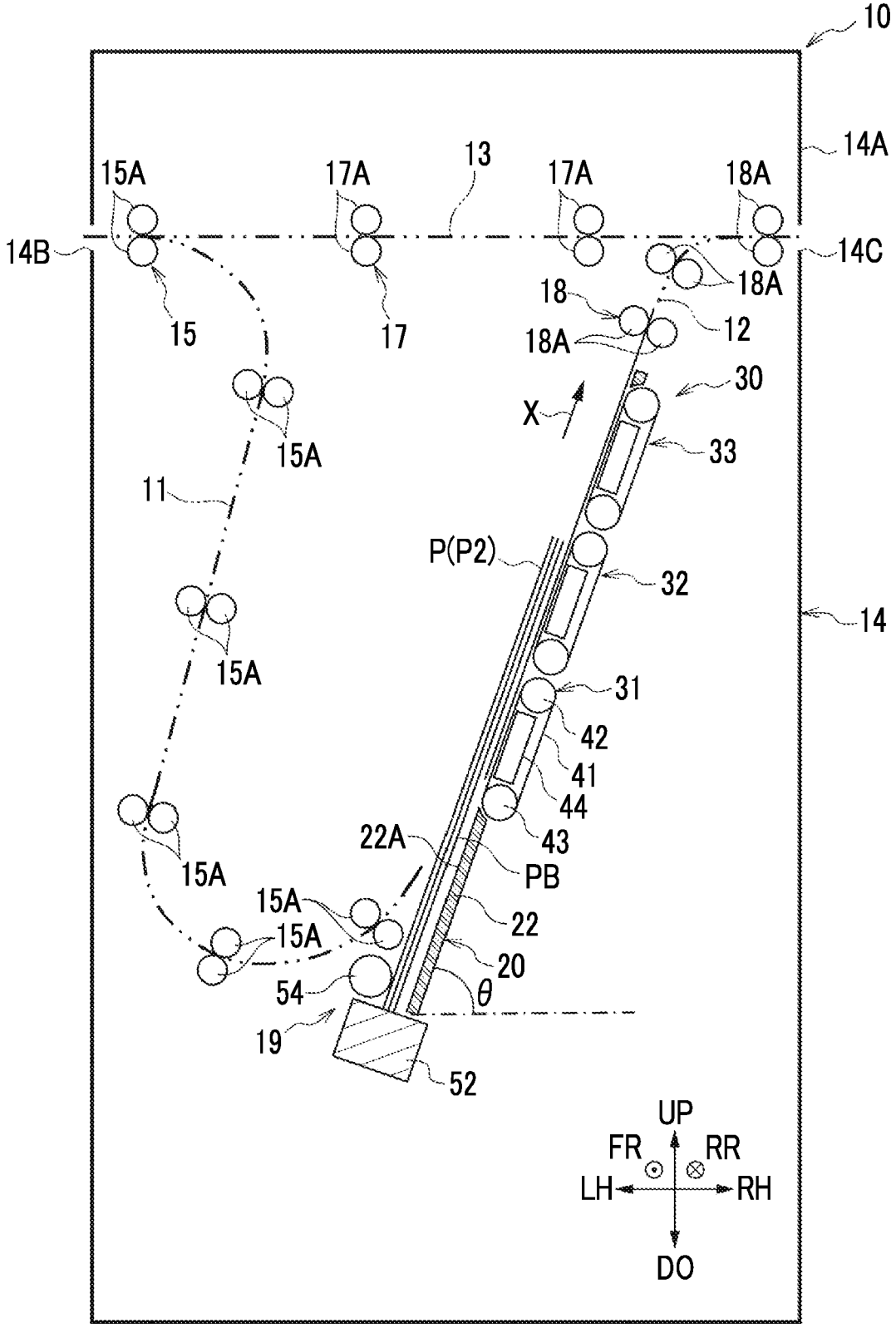
FIG. 11 is an operation view illustrating an operation of feeding the second recording medium in the transporting device according to the present exemplary embodiment.

As illustrated in FIG. 11, in a case where the second recording medium P2, which is transported from the third transporting portion 33, is delivered to the second transporting mechanism 18, the third transporting portion 33 stops the suction. As described above, the second recording medium P2 is fed from the loading portion 20.

Feeding Operation of Third Recording Medium P3

Figure 12:
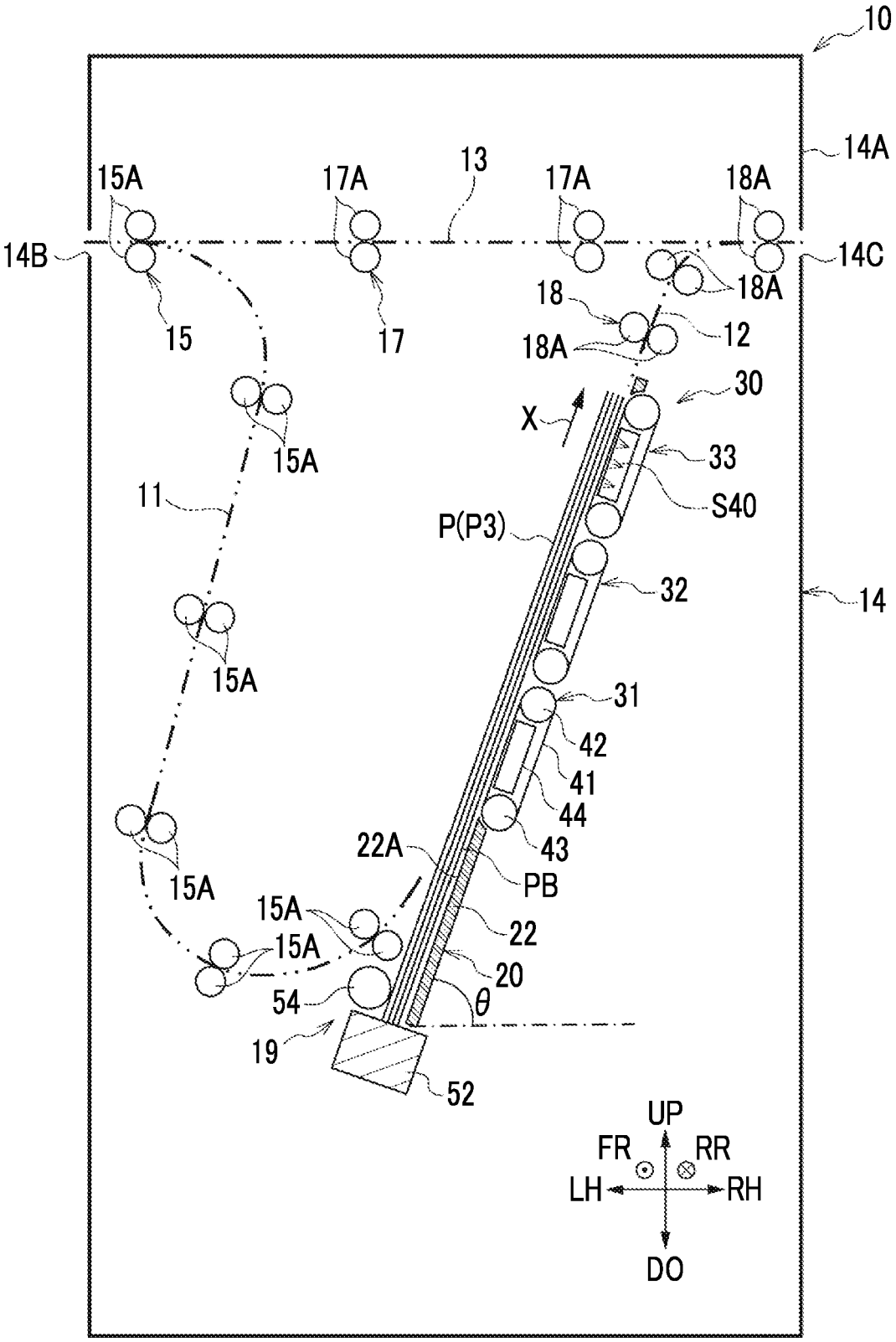
FIG. 12 is an operation view illustrating an operation of feeding a third recording medium in the transporting device according to the present exemplary embodiment.

In the feeding mechanism 30, as illustrated in FIG. 12, the third transporting portion 33 transports the third recording medium P3, which is in contact with the loading surface 22A, obliquely upward along the loading surface 22A while sucking the lower side PB of the third recording medium P3 on a downstream end side in the feeding direction by the suction portion 40.

Figure 13:
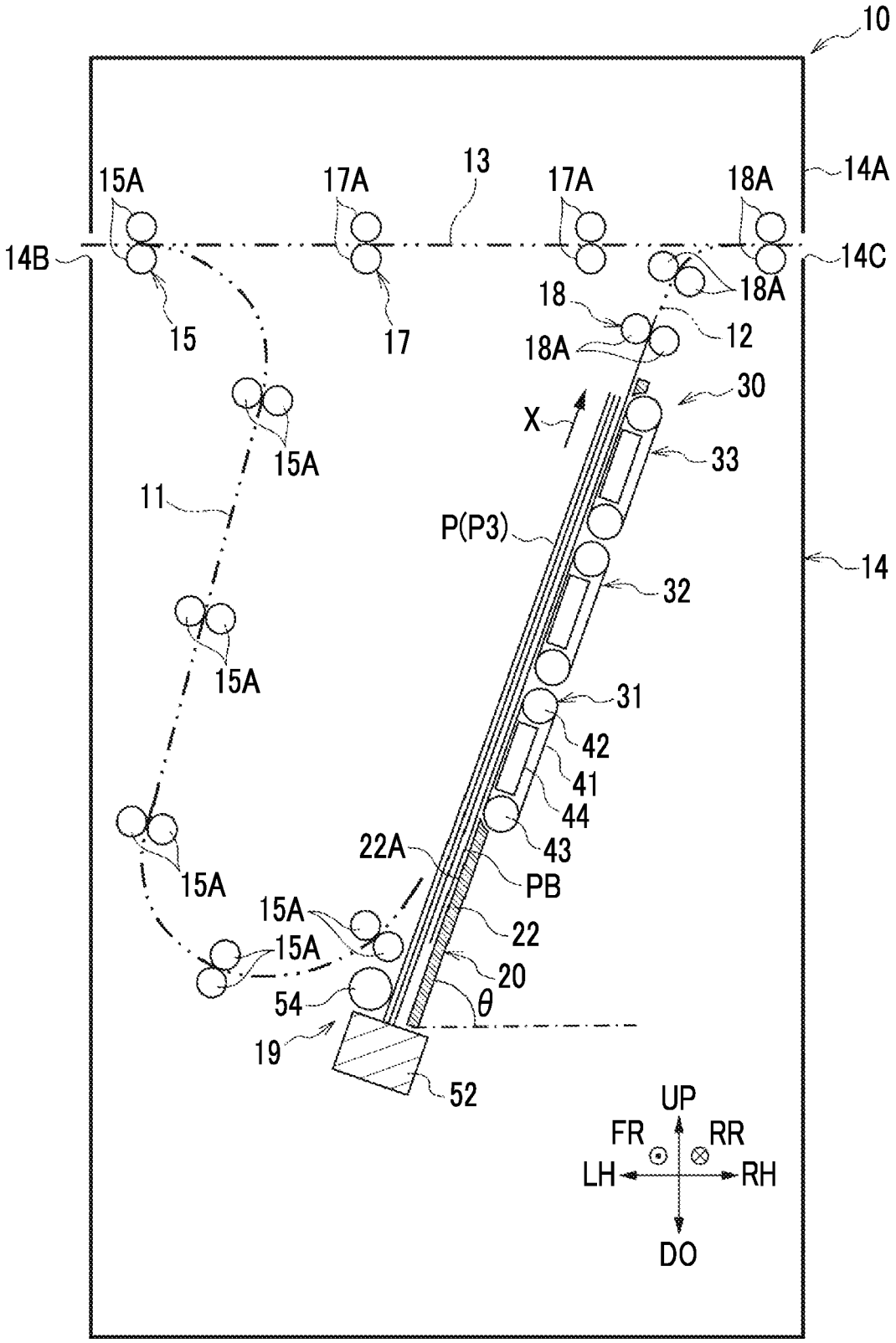
FIG. 13 is an operation view illustrating an operation of feeding the third recording medium in the transporting device according to the present exemplary embodiment.

As illustrated in FIG. 13, in a case where the third recording medium P3, which is transported from the third transporting portion 33, is delivered to the second transporting mechanism 18, the third transporting portion 33 stops the suction. As described above, the third recording medium P3 is fed from the loading portion 20.

Operations According to Present Exemplary Embodiment

Next, operations according to the present exemplary embodiment will be described.

According to the present exemplary embodiment, the loading portion 20, which is disposed on the downstream side of the first transporting path 11 in the transporting direction, loads the recording medium P, which is transported through the first transporting path 11, on the loading surface 22A that is inclined with respect to the horizontal direction. The feeding mechanism 30 feeds the recording medium P, which is in contact with the loading surface 22A, obliquely upward along the loading surface 22A.

Figure 14:
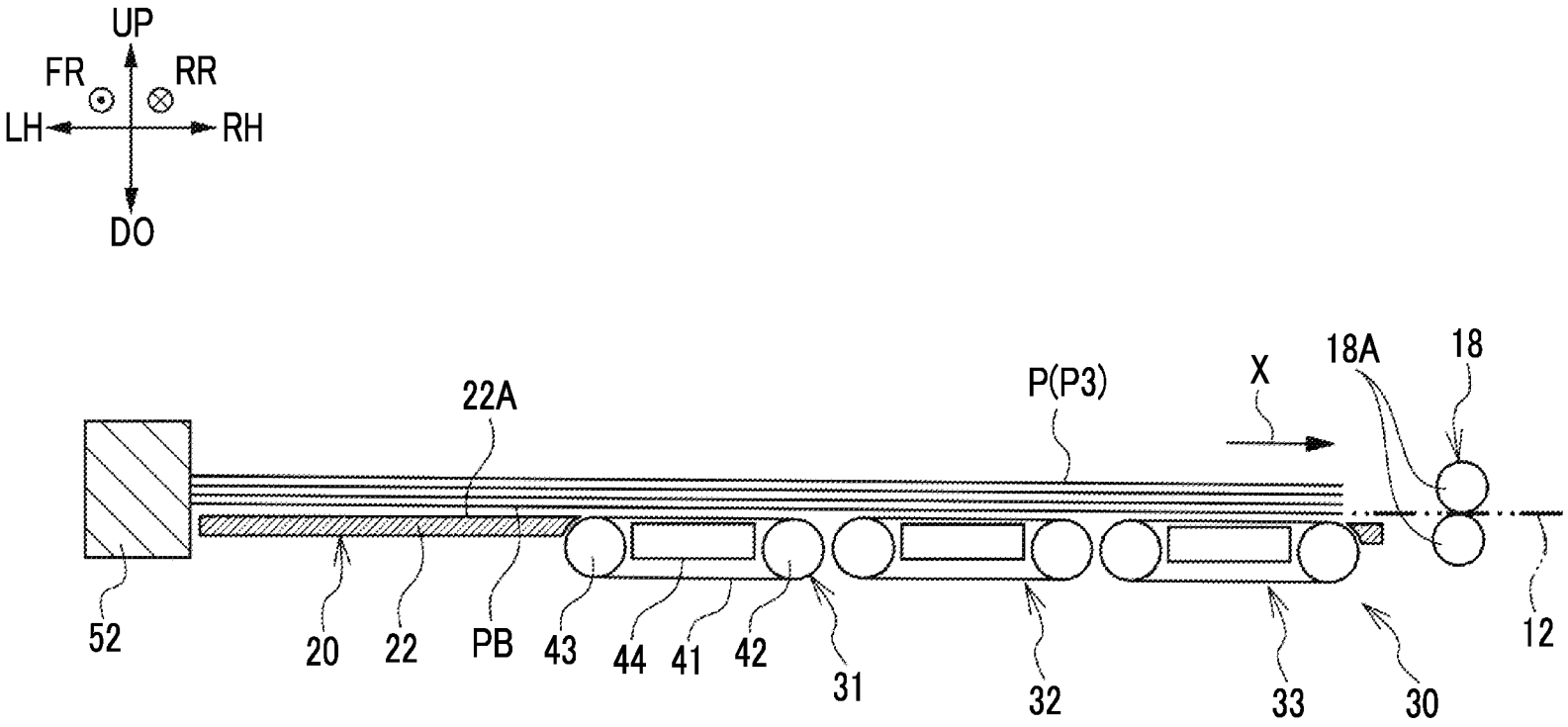
FIG. 14 is a schematic view illustrating a feeding device according to a comparative example.

Here, as illustrated in FIG. 14, in a case where the recording medium P, which is loaded on the loading surface 22A along the horizontal direction, is fed along the horizontal direction (hereinafter, referred to as a mode A), since the weight of the recording media P, which is loaded on the loading surface 22A, acts in the load direction, double feeding of the recording medium P (a plurality of recording media P are overlapped and fed) may occur in a case where the feeding mechanism 30 feeds the recording medium P.

In contrast, in the present exemplary embodiment, since the feeding mechanism 30 feeds the recording medium P obliquely upward along the loading surface 22A, the weight of the recording medium P acts toward the upstream side in the feeding direction, thereby double feeding of the recording medium P is suppressed in the feeding device 19 as compared with the mode A. As a result, a transporting failure of the recording medium P is suppressed in the transporting device 10. As a result, a processing failure of the post-processing with respect to the recording medium P on which an image is formed is suppressed.

Further, in the present exemplary embodiment, the feeding mechanism 30 feeds the recording medium P, which is in contact with the loading surface 22A, obliquely upward along the loading surface 22A while sucking the lower side of the recording medium P.

Therefore, as compared with a case where the feeding mechanism 30 feeds the recording medium P only by friction with the recording medium P, the recording medium P can be transported against the transport resistance acting on the recording medium P, which is in contact with the loading surface 22A, and a feeding failure of the recording medium P is suppressed.

Further, in the present exemplary embodiment, in the feeding mechanism 30, the first transporting portion 31 transports the first recording medium P1, which is in contact with the loading surface 22A, obliquely upward along the loading surface 22A while sucking the lower side of the first recording medium P1 on a downstream end side in the feeding direction. Further, the second transporting portion 32, which is disposed on the downstream side of the first transporting portion 31 in the feeding direction, transports the second recording medium P2, which is in contact with the loading surface 22A, obliquely upward along the loading surface 22A while sucking the lower side of the second recording medium P2 on the downstream end side in the feeding direction.

As described above, in the feeding mechanism 30, regarding the second recording medium P2, which has a larger dimension along the feeding direction than a dimension of the first recording medium P1, the second transporting portion 32, which is disposed on the downstream side of the first transporting portion 31 in the feeding direction, transports the second recording medium P2 while sucking the lower side of the second recording medium P2 on the downstream end side in the feeding direction. Therefore, a feeding failure of the second recording medium P2 is suppressed as compared with a case where the feeding mechanism 30 has only the first transporting portion 31.

Further, in the present exemplary embodiment, the second transporting portion 32 transports the first recording medium P1, which is transported from the first transporting portion 31, and the first transporting portion 31 stops the suction in a state in which the second transporting portion 32 transports the first recording medium P1.

Therefore, in a state in which the second transporting portion 32 transports the first recording medium P1, double feeding of the first recording medium P1 is suppressed as compared with a case where the suction of the first transporting portion 31 continues.

Further, in the present exemplary embodiment, the contact portion 52, which is provided on the upstream side in the feeding direction with respect to the loading portion 20, comes into contact with an upstream end of the recording medium P, which is loaded on the loading portion 20, in the feeding direction to align the upstream end.

Here, in a case where the contact portion 52 is provided on the downstream side in the feeding direction with respect to the loading portion 20 (hereinafter, referred to as a mode B), the recording medium P is moved obliquely downward due to the weight of the recording medium P and is easily separated from the contact portion 52. In contrast, in the present exemplary embodiment, since the contact portion 52 is provided on the upstream side in the feeding direction with respect to the loading portion 20, the recording medium P is less likely to separate from the contact portion 52 as compared with the mode B, and variation in a loading position of the recording medium P along the loading surface 22A is suppressed.

Further, in the present exemplary embodiment, a position of the contact portion 52 is fixed with respect to the loading portion 20. Here, in a case where the position of the contact portion 52 can be changed along the feeding direction (hereinafter, referred to as a mode C), the position of the recording medium P on the upstream end in the feeding direction tends to fluctuate, and the loading position of the recording medium P along the loading surface 22A tends to vary.

In contrast, in the present exemplary embodiment, since the position of the contact portion 52 is fixed, the variation in the loading position of the recording medium P along the loading surface 22A is suppressed as compared with the mode C.

Further, in the present exemplary embodiment, the applying roll 54 applies the movement force to the recording medium P, which is loaded on the uppermost side in the loading portion 20, toward the contact portion 52 side (specifically, the obliquely lower left side) to bring the recording medium P into contact with the contact portion 52.

Therefore, variation in the loading position of the recording medium P along the loading surface 22A is suppressed as compared with the case where the movement force, in which the recording medium P that is loaded on the loading portion 20 is moved toward the contact portion 52, is only the weight of the recording medium P.

Further, in the present exemplary embodiment, the applying roll 54 applies the movement force to the recording medium P, which is loaded on the uppermost side in the loading portion 20, toward the contact portion 52 side during a feeding operation of the feeding mechanism 30.

Therefore, double feeding of the recording medium P is suppressed as compared with the case where the applying roll 54 applies the movement force to the recording medium P, which is loaded on the uppermost side in the loading portion 20, toward the contact portion 52 side only in a state in which the feeding operation of the feeding mechanism 30 is stopped.

Further, in the present exemplary embodiment, the loading portion 20 loads the recording medium P, which is transported through the first transporting path 11, from the upstream side of the loading portion 20 in the feeding direction.

Therefore, interference by the recording media P, which is fed from the loading portion 20, is suppressed by the transported recording medium P as compared with a case where the loading portion 20 loads the recording media P, which is transported through the first transporting path 11 from the downstream side of the loading portion 20 in the feeding direction. As a result, the recording medium P can be fed from the loading portion 20 while being loaded on the loading portion 20.

Further, in the present exemplary embodiment, the feeding mechanism 30 can feed the recording medium P, which is in contact with the loading surface 22A, obliquely upward along the loading surface 22A while the loading portion 20 further loads the recording medium P in a state in which the loading portion 20 loads the recording medium P.

Therefore, the degree of freedom in the timing at which the feeding mechanism 30 feeds the recording medium P is high as compared with the case where the feeding mechanism 30 can feed the recording medium P only in a state in which the recording medium P is not being loaded by the loading portion 20. In other words, the feeding mechanism 30 can feed the recording medium P at a desired timing, for example, regardless of whether or not the recording medium P is being loaded by the loading portion 20.

Further, in the present exemplary embodiment, the loading surface 22A is inclined in a range of 45 degrees or more and less than 90 degrees with respect to the horizontal direction. Therefore, double feeding of the recording medium P is suppressed as compared with a case where the loading surface 22A is inclined in a range of less than 45 degrees with respect to the horizontal direction.

Further, in the present exemplary embodiment, the loading surface 22A is, for example, preferably inclined in a range of 60 degrees or more and less than 85 degrees with respect to the horizontal direction. Therefore, double feeding of the recording media P is suppressed as compared to the case where the loading surface 22A is inclined in a range of less than 60 degrees with respect to the horizontal direction, and buckling of the recording medium P is suppressed as compared with the case where the loading surface 22A is inclined in a range exceeding 85 degrees with respect to the horizontal direction.

Further, in the present exemplary embodiment, the bypassing circuit 13 transports the recording medium P, which is transported from the pre-processing apparatus 110, to the second transporting path 12 by bypassing the feeding device 19. Therefore, as compared with the case where the transporting device 10 includes only the first transporting path 11 and the second transporting path 12 as transporting paths, the degree of freedom in selecting the length of the transport time for transporting the recording medium P, which is transported from the pre-processing apparatus 110, to the post-processing apparatus 120, is high.

Modification Example

In the present exemplary embodiment, since the pre-processing apparatus 110 is an image forming apparatus, the recording medium P is transported as an example of a transporting target, but the present exemplary embodiment is not limited thereto. The transporting target may be determined according to pre-processing executed by the pre-processing apparatus 110, and various transportable targets may be used as the transporting target.

Further, in the present exemplary embodiment, the feeding mechanism 30 feeds the recording medium P, which is in contact with the loading surface 22A, obliquely upward along the loading surface 22A while sucking the lower side of the recording medium P, but the present exemplary embodiment is not limited thereto. For example, the feeding mechanism 30 may be configured to feed the recording medium P only by friction with the recording medium P, and the feeding mechanism 30 may be configured to feed the recording medium P.

Further, in the present exemplary embodiment, the feeding mechanism 30 includes the first transporting portion 31, the second transporting portion 32, and the third transporting portion 33, but the present exemplary embodiment is not limited thereto. For example, the feeding mechanism 30 may have a configuration in which only one of the first transporting portion 31, the second transporting portion 32, and the third transporting portion 33 is included, or may have a configuration in which any two of the first transporting portion 31, the second transporting portion 32, and the third transporting portion 33 are included. Further, the feeding mechanism 30 may have a configuration in which one or a plurality of transporting portions are included in addition to the first transporting portion 31, the second transporting portion 32, and the third transporting portion 33.

Further, in the present exemplary embodiment, the second transporting portion 32 transports the first recording medium P1, which is transported from the first transporting portion 31, and the first transporting portion 31 stops the suction in a state in which the second transporting portion 32 transports the first recording medium P1, but the present exemplary embodiment is not limited thereto. For example, a configuration may be used in which the suction of the first transporting portion 31 is continued in a state where the second transporting portion 32 transports the first recording medium P1. In a state where the third transporting portion 33 transports the first recording medium P1 or the second recording medium P2, which is transported from the second transporting portion 32, while sucking the lower side PB of the first recording medium P1 or the second recording medium P2 by the suction portion 40, similarly, even in a case where the second transporting portion 32 stops the suction, a configuration may be adopted in which the suction is continued.

Further, in the present exemplary embodiment, the contact portion 52, which is provided on the upstream side in the feeding direction with respect to the loading portion 20, comes into contact with an upstream end of the recording medium P, which is loaded on the loading portion 20, in the feeding direction to align the upstream end, but the present exemplary embodiment is not limited thereto. For example, a configuration may be used in which the contact portion 52 is provided on the downstream side in the feeding direction with respect to the loading portion 20.

Further, in the present exemplary embodiment, a position of the contact portion 52 is fixed with respect to the loading portion 20, but the present exemplary embodiment is not limited thereto. For example, a configuration may be used in which the position of the contact portion 52 can be changed along the feeding direction.

Further, in the present exemplary embodiment, the applying roll 54 applies the movement force to the recording medium P, which is loaded on the uppermost side in the loading portion 20, toward the contact portion 52 side (specifically, the obliquely lower left side) to bring the recording medium P into contact with the contact portion 52, but the present exemplary embodiment is not limited thereto. For example, a configuration may be used in which the movement force, where the recording medium P that is loaded on the loading portion 20 is moved toward the contact portion 52 side, is only the weight of the recording medium P.

Further, in the present exemplary embodiment, the applying roll 54 applies the movement force to the recording medium P, which is loaded on the uppermost side in the loading portion 20, toward the contact portion 52 side during a feeding operation of the feeding mechanism 30, but the present exemplary embodiment is not limited thereto. For example, a configuration may be used in which the applying roll 54 applies the movement force to the recording medium P, which is loaded on the uppermost side in the loading portion 20, toward the contact portion 52 side only in a state in which the feeding operation of the feeding mechanism 30 is stopped.

Further, in the present exemplary embodiment, the loading portion 20 loads the recording medium P, which is transported through the first transporting path 11, from the upstream side of the loading portion 20 in the feeding direction, but the present exemplary embodiment is not limited thereto. For example, a configuration may be used in which the loading portion 20 loads the recording medium P, which is transported through the first transporting path 11, from the downstream side of the loading portion 20 in the feeding direction.

Further, in the present exemplary embodiment, the feeding mechanism 30 can feed the recording medium P, which is in contact with the loading surface 22A, obliquely upward along the loading surface 22A while the loading portion 20 further loads the recording medium Pin a state in which the loading portion 20 loads the recording medium P, but the present exemplary embodiment is not limited thereto. For example, a configuration may be used in which the feeding mechanism 30 can feed the recording medium P only in a state in which the recording medium P is not being loaded by the loading portion 20.

Further, in the present exemplary embodiment, the loading surface 22A is inclined in a range of 45 degrees or more and less than 90 degrees with respect to the horizontal direction, but the present exemplary embodiment is not limited thereto. For example, a configuration may be used in which the loading surface 22A is inclined in a range of less than 45 degrees with respect to the horizontal direction.

Further, in the present exemplary embodiment, the bypassing circuit 13 transports the recording medium P, which is transported from the pre-processing apparatus 110, to the second transporting path 12 by bypassing the feeding device 19, but the present exemplary embodiment is not limited thereto. For example, a configuration may be used in which the transporting device 10 includes only the first transporting path 11 and the second transporting path 12 as transporting paths.

The exemplary embodiment of the present invention is not limited to the above-described exemplary embodiment, and various modifications, changes, and improvements can be made within a range that does not deviate from the gist thereof. For example, a plurality of the modification examples illustrated above may be combined and configured as appropriate.

Supplementary Note (((1)))

A feeding device comprising:

a loading portion that is disposed on a downstream side of a transporting path in a transporting direction and that loads a transporting target, which is transported through the transporting path, on a loading surface inclined with respect to a horizontal direction; and a feeding unit that feeds the transporting target, which is in contact with the loading surface, obliquely upward along the loading surface.

(((2)))

The feeding device according to (((1))), wherein the feeding unit feeds the transporting target, which is in contact with the loading surface, obliquely upward along the loading surface while sucking a lower side of the transporting target.

(((3)))

The feeding device according to (((2))), wherein the loading portion is capable of loading, as the transporting target, a first transporting target and a second transporting target, which has a larger dimension along a feeding direction than a dimension of the first transporting target, and the feeding unit includes a first transporting portion that transports the first transporting target, which is in contact with the loading surface, obliquely upward along the loading surface while sucking a lower side of the first transporting target on a downstream end side in the feeding direction, and a second transporting portion that is disposed on a downstream side of the first transporting portion in the feeding direction and that transports the second transporting target, which is in contact with the loading surface, obliquely upward along the loading surface while sucking a lower side of the second transporting target on a downstream end side in the feeding direction.

(((4)))

The feeding device according to (((3))), wherein the second transporting portion transports the first transporting target transported from the first transporting portion, and the first transporting portion stops suction in a state in which the second transporting portion transports the first transporting target.

(((5)))

The feeding device according to any one of (((1))) to (((4))), further comprising:

a contact portion that is provided on an upstream side in a feeding direction with respect to the loading portion and that comes into contact with an upstream end of the transporting target, which is loaded on the loading portion, in the feeding direction to align the upstream end.

(((6)))

The feeding device according to (((5))), wherein a position of the contact portion is fixed with respect to the loading portion.

(((7)))

The feeding device according to (((5))), further comprising:

an applying portion that applies a movement force to a transporting target, which is loaded on an uppermost side of the loading portion, toward a contact portion side to bring the transporting target into contact with the contact portion.

(((8)))

The feeding device according to (((7))), wherein the applying portion applies the movement force to the transporting target, which is loaded on the uppermost side of the loading portion, toward the contact portion side during a feeding operation of the feeding unit.

(((9)))

The feeding device according to any one of (((1))) to (((8))), wherein the loading portion loads the transporting target transported through the transporting path from an upstream side in a feeding direction with respect to the loading portion.

(((10)))

The feeding device according to any one of (((1))) to (((9))), wherein the feeding unit is capable of feeding the transporting target, which is in contact with the loading surface, obliquely upward along the loading surface while the loading portion further loads, in a state in which the transporting target is loaded, a transporting target.

(((11)))

The feeding device according to any one of (((1))) to (((10))), wherein the loading surface is inclined in a range of 45 degrees or more and less than 90 degrees with respect to the horizontal direction.

(((12)))

The feeding device according to (((11))), wherein the loading surface is inclined in a range of 60 degrees or more and less than 85 degrees with respect to the horizontal direction.

(((13)))

A transporting device comprising:

the feeding device according to (((1))) to (((12)));

a first transporting path as the transporting path for transporting a transporting target, which is transported from a pre-processing apparatus, to the loading portion of the feeding device; and a second transporting path for transporting the transporting target, which is fed from the feeding device, to a post-processing apparatus.

(((14)))

The transporting device according to (((13))), further comprising:

a bypassing circuit that transports the transporting target, which is transported from the pre-processing apparatus, to the second transporting path by bypassing the feeding device.

(((15)))

A processing system comprising:

a pre-processing apparatus that executes pre-processing;

a post-processing apparatus that executes post-processing; and the transporting device according to (((13))) or (((14))) that transports a transporting target, which is transported from the pre-processing apparatus, to the post-processing apparatus.

(((16)))

The processing system according to (((15))), wherein the pre-processing apparatus is an image forming apparatus that forms an image on a recording medium, which is used as the transporting target.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A feeding device comprising:

a loading member having a loading surface inclined with respect to a horizontal direction, wherein the loading member is disposed on a downstream side of a transporting path in a transporting direction and configured to load a transporting target, which is transported through the transporting path; and a feeding mechanism configured to feed the transporting target, which is in contact with the loading surface, obliquely upward along the loading surface, wherein the loading member is capable of loading, as the transporting target, a first transporting target and a second transporting target, which has a larger dimension along a feeding direction than a dimension of the first transporting target, and the feeding mechanism includes a first transporting portion that transports the first transporting target, which is in contact with the loading surface, obliquely upward along the loading surface while sucking a lower side of the first transporting target on a downstream end side in the feeding direction, and a second transporting portion that is disposed on a downstream side of the first transporting portion in the feeding direction and that transports the second transporting target, which is in contact with the loading surface, obliquely upward along the loading surface while sucking a lower side of the second transporting target on a downstream end side in the feeding direction, wherein the second transporting portion transports the first transporting target transported from the first transporting portion, and the first transporting portion stops suction in a state in which the second transporting portion transports the first transporting target.

2. The feeding device according to claim 1, further comprising:

a contact wall that is provided on an upstream side in a feeding direction with respect to the loading member and that comes into contact with an upstream end of the transporting target, which is loaded on the loading member, in the feeding direction to align the upstream end.

3. The feeding device according to claim 2, wherein a position of the contact wall is fixed with respect to the loading member.

4. The feeding device according to claim 2, further comprising:

an applying roll that applies a movement force to a transporting target, which is loaded on an uppermost side of the loading member, toward a contact wall side to bring the transporting target into contact with the contact wall.

5. The feeding device according to claim 4, wherein the applying roll applies the movement force to the transporting target, which is loaded on the uppermost side of the loading member, toward the contact wall side during a feeding operation of the feeding mechanism.

6. The feeding device according to claim 1, wherein the loading member loads the transporting target transported through the transporting path from an upstream side in a feeding direction.

7. The feeding device according to claim 1, wherein the feeding mechanism is capable of feeding the transporting target, which is in contact with the loading surface, obliquely upward along the loading surface while the loading member further loads, in a state in which the transporting target is loaded, a transporting target.

8. The feeding device according to claim 1, wherein the loading surface is inclined in a range of 45 degrees or more and less than 90 degrees with respect to the horizontal direction.

9. The feeding device according to claim 8, wherein the loading surface is inclined in a range of 60 degrees or more and less than 85 degrees with respect to the horizontal direction.

10. A transporting device comprising:

a feeding device, comprising:

a loading member having a loading surface inclined with respect to a horizontal direction, wherein the loading member is disposed on a downstream side of a transporting path in a transporting direction and configured to load a transporting target, which is transported through the transporting path; and a feeding mechanism configured to feed the transporting target, which is in contact with the loading surface, obliquely upward along the loading surface;

a first transporting path as the transporting path for transporting a transporting target, which is transported from a pre-processing apparatus, to the loading member of the feeding device;

a second transporting path for transporting the transporting target, which is fed from the feeding device, to a post-processing apparatus; and a third transporting path that transports the transporting target, which is transported from the pre-processing apparatus, to the second transporting path by bypassing the feeding device.

11. A processing system comprising:

a pre-processing apparatus that executes pre-processing;

a post-processing apparatus that executes post-processing; and the transporting device according to claim 10 that transports a transporting target, which is transported from the pre-processing apparatus, to the post-processing apparatus.

12. The processing system according to claim 11, wherein the pre-processing apparatus is an image forming apparatus that forms an image on a recording medium, which is used as the transporting target.

13. A feeding device comprising:

a loading means that has a loading surface inclined with respect to a horizontal direction and is disposed on a downstream side of a transporting path in a transporting direction and that loads a transporting target, which is transported through the transporting path; and a feeding means for feeding the transporting target, which is in contact with the loading surface, obliquely upward along the loading surface, wherein the loading means is capable of loading, as the transporting target, a first transporting target and a second transporting target, which has a larger dimension along a feeding direction than a dimension of the first transporting target, and the feeding means includes a first transporting portion that transports the first transporting target, which is in contact with the loading surface, obliquely upward along the loading surface while sucking a lower side of the first transporting target on a downstream end side in the feeding direction, and a second transporting portion that is disposed on a downstream side of the first transporting portion in the feeding direction and that transports the second transporting target, which is in contact with the loading surface, obliquely upward along the loading surface while sucking a lower side of the second transporting target on a downstream end side in the feeding direction, wherein the second transporting portion transports the first transporting target transported from the first transporting portion, and the first transporting portion stops suction in a state in which the second transporting portion transports the first transporting target.

* * * * *